US007229136B2

(12) United States Patent
Sollami

(10) Patent No.: US 7,229,136 B2
(45) Date of Patent: Jun. 12, 2007

(54) NON-ROTATABLE WEAR RING AND RETAINER SLEEVE FOR A ROTATABLE TOOL

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 10/952,158

(22) Filed: Sep. 28, 2004

(65) Prior Publication Data

US 2006/0071538 A1 Apr. 6, 2006

(51) Int. Cl.
*E21C 35/197* (2006.01)

(52) U.S. Cl. ..... 299/104; 299/107

(58) Field of Classification Search ..... 299/102–107, 299/110–111

See application file for complete search history.

(56) References Cited

U.S. PATENT DOCUMENTS 4,818,027 A 4/1989 Simon
4,844,550 A 7/1989 Beebe
5,931,542 A 8/1999 Britzke
6,508,516 B1 1/2003 Kammerer
6,692,083 B2 2/2004 Latham

FOREIGN PATENT DOCUMENTS

WO WO 03/042500 * 5/2003

* cited by examiner

*Primary Examiner*—Sunil Singh
(74) *Attorney, Agent, or Firm*—Robert L. Marsh

(57) ABSTRACT

A compressible sleeve for fitting around the shank of a rotatable tool has a cut out portion at the forward end thereof. The sleeve is compressed to a diameter less than the inner diameter of the bore of a tool holder by an annular wear ring having a generally cylindrical central opening with a diameter larger than the diameter of the bore of the tool holder, but having an inwardly directed projection that retains the cylindrical sleeve in a diameter that is less than the diameter of the bore of the tool holder. When the shank of the tool is subsequently driven into the bore of the tool holder, the wear ring is forced forwardly along the sleeve until the projection of the wear ring falls between the cut out portions of the sleeve thereby allowing the sleeve to expand to the diameter of the bore of the tool holder. The outer walls of the cut out portion of the sleeve engage the ends of the inwardly directed projection of the wear ring thereby preventing the wear ring from rotating with the tool.

19 Claims, 7 Drawing Sheets

NON-ROTATABLE WEAR RING AND RETAINER SLEEVE FOR A ROTATABLE TOOL

The present application relates to rotatable tools mounted in non-rotatable retainers in machines used to cut hard surfaces, and in particular to an improved retainer sleeve for retaining the shank of the tool in the tool holder, and in improved wear ring positioned between the tool and the tool holder.

BACKGROUND OF THE INVENTION

Machines for cutting hard surfaces, such as used in the trenching and mining industries and for removing the upper surfaces of concrete and asphalt pavement, employ tools fitted into tool holders on a rotatable wheel or drum. The tools have a tapered forward cutting end and axially located behind the forward cutting end is a cylindrical shank that rotatably fits within a complementarily shaped bore in the tool holder. Between the forward cutting end and the shank, the tools have a rearwardly directed annular surface or flange that contacts the forward surface of the tool holder. Force is applied through the rotating drum or wheel to the tool holder and through the radial flange to the tool to thereby force the tool into the hard surface to be cut.

The shank of the tool is retained in the bore of the tool holder by a sleeve made of a spring steel that fits around the shank of the tool and engages a shoulder on the shank to prevent the shank from being removed from the sleeve. The sleeve is compressed during the insertion of the shank and sleeve into the bore of the tool holder after which the radially outward force applied by the sleeve against the inner wall of the bore retains the shank of the tool within the bore. The radially outwardly directed force applied by the sleeve as it is compressed prior to insertion into the bore of the tool holder also complicates the insertion process.

To receive the tool and compressed sleeve, the bore of the tool holder has a frustoconical countersink, with the outermost diameter of the countersink being larger than the outermost diameter of the unstressed sleeve. To insert the tool into the tool holder, the distal end of the shank is fitted into the bore with the rearward edge of the sleeve abutting the frustoconical surface of the countersink surrounding the bore. Thereafter, the nose of the tool is struck with a hammer or the like, forcing the shank of the tool and the sleeve rearwardly. As the sleeve moves axially into the bore, it is compressed by the frustoconical countersink.

The insertion of the tool into a tool holder require a machine operator to use both hands. In many cases, however, the drum or wheel of the machine is in such an orientation that the tool holder is inaccessible to both hands of the technician without a time consuming repositioning of the drum or the technician's body. It would greatly simplify the insertion of replacement tools in the tool holders of a machine if a technician could position and insert the tool into a tool holder using only one hand.

During the operation of such machines, the useful life of the tools is enhanced by the rotation of the tool, causing it to wear evenly around its circumference. The tools are mounted at an angle of about seven degrees on the drum or wheel and the contact of the tool body with the surface to be cut applies a component of force to the side of the tool that is perpendicular to the axis of rotation. The rotation of the flange of the tool against the forward surface of the tool holder causes wear to the forward surface of the tool holder. To prevent such wear, it has become common to provide an annular wear ring around the shank of the tool between the forward surface of the tool holder and the rearwardly directed flange of the tool.

When the wear ring operates properly, the wear ring remains stationary against the forward surface of the tool holder while the tool rotates against the forward surface of the wear ring such that only the forward surface becomes worn away. Currently existing wear rings are retained in the stationary position by the resistance caused between the forward end of the tool holder and the rearward surface of the wear ring, which is generally greater than the resistance between the forward surface of the wear ring and the rearwardly directed radial flange of the tool. Although this is so, there is a tendency for the wear ring to rotate with respect to the forward end of the tool holder. The same forces that cause the tool body to rotate also cause the wear ring to rotate. Considering that a tool may undergo as many fifty thousand rotations within a single day, the forward end of the tool holder will undergo a significant wear caused by the rotation of the wear ring. To minimize the rotation of a wear ring that is retained by friction between the forward end of the tool holder and the rear surface of the wear ring, it is desirable that the outer diameter of the wear ring be no greater than, or even smaller than, the outer diameter of the radial flange of the tool body. It would be desirable, therefore, to provide a wear ring that is retained against rotation with respect to the tool holder.

Several problems are also encountered in removing the tool from a tool holder. Presently, it is the practice to provide an annular groove around the tapered forward cutting end of the tool that can be grasped by the prongs of an extraction tool. Where a wear ring is fitted around the shank of the tool, the use of existing extraction tools may result in the wear ring falling off the end of the shank of the tool onto the work surface below the machine. As a result, the machine operator may be required to collect the dropped wear rings after the defective tools of the machine have been replaced.

Several efforts have been made to overcome the foregoing problems, and one of the most notable is disclosed by Simon, U.S. Pat. No. 4,818,027. Simon discloses a rotatable tool having an axial shank, a compressible sleeve fitted around the shank, and a wear ring fitted around the compressible sleeve with the inner diameter of the wear ring equal to or less than the diameter of the bore of the tool holder. The shank has a shoulder at the forward end thereof that is spaced from the radial flange, and the forward end of the sleeve abuts against the shoulder. With the sleeve compressed by the wear ring, the distal end of the shank can be more easily fitted into the bore of the tool holder to thereby facilitate the insertion of the shank of the tool. As the shank of the tool is driven deeper and deeper into the bore, the wear ring is forced forwardly off of the forward end of the sleeve after which all the radially outwardly directed forces of the compressed sleeve are applied to the inner surface of the bore to retain the tool in the bore.

Although the device of Simon does assist in the insertion of the shank of the tool into a tool holder, and provides for a wear ring between the forward surface of the tool holder and the rearwardly directed annular surface of the flange, the wear ring is retained against rotation with the tool only by the friction between the forward surface of the tool holder and the rearward surface of the wear ring and therefore rotates with the tool.

There are certain problems that have been found with the structure of the sleeve and wear ring of Simon. The rotation of the shank within the sleeve of Simon requires that the forward edge of the sleeve abut against the annular shoulder that is spaced from the surface of the radial flange. However, it has been found during the use of the tool the sleeve becomes somewhat extruded, causing it to lengthen, and as the sleeve lengthens the forward end thereof is forced over the annular shoulder. The sleeve then becomes pinched between the enlarged diameter portion of the shank adjacent the radial flange and the bore of the tool holder, thereby preventing or inhibiting the rotation of the tool. Where the tool fails to rotate properly, it will become prematurely worn and reduce the efficiency of the machine or require frequent service.

Products currently made in accordance with Simon include a wear ring with an inner diameter equal to the diameter of the bore, and as a result, the distal end of the shank cannot be manually inserted into the bore of a tool holder using one hand. Efforts to provide a wear ring having a central opening that is less than the diameter of the bore to thereby further compress the sleeve until the distal end of the shank and sleeve may be manually fitted within the bore have resulted in an increase in the incidence of wedging between the shank and the bore. This is because the bore of the wear ring must be made smaller than the diameter of the bore of the holder, and since the enlarged portion of the shank must rotate within the bore of the wear ring, the shoulder at the forward end of the shank must be correspondingly reduced.

SUMMARY OF THE INVENTION

Briefly, the present invention is embodied in a compressible sleeve and an associated wear ring, which overcome or greatly reduce the forgoing problems. The tool for which the sleeve and wear ring of the present invention are used, includes a tapered forward cutting end, an axial shaft extending rearwardly of the forward cutting end, and a rearwardly facing annular surface joining the rearward end of the forward cutting end and the forward end of the shank. Fitted around the shank is a compressible sleeve having an axis and having a forward end that abuts against the rearwardly facing annular surface of the forward cutting end of the tool.

In accordance with the invention, the compressible sleeve has a cut out portion at the forward end thereof. Fitted around the circumference of the sleeve is an annular wear ring having a central opening, the inner diameter of which is less than the diameter of the bore of the tool holder in which the shank is to be fitted. The wear ring has a protrusion extending radially inwardly of the central opening thereof such that when the wear ring is fitted around the central portion of the sleeve, the sleeve will be compressed between the distal end of the protrusion and the opposing wall of the central opening of the wear ring to a diameter that is less than the diameter of the bore of the hole into which the tool is to be fitted.

With the parts assembled as described above, a machine operator can, with one hand, insert the distal end of the shank and compressed sleeve into the bore of a tool holder until the rearward surface of the wear ring abuts the forward surface of the tool holder. With the tool partially inserted into the tool holder, the technician can release his grip on the tool, grasp a hammer, and pound the nose of the tool until the balance of the shank is driven into the bore.

As the machine operator pounds the nose of the tool, the shank is driven into the bore, the wear ring is moved forwardly along the length of the sleeve until the protrusion drops into the cut out portion of the sleeve, thereby allowing the sleeve to expand until its outer surface abuts the inner surface of the bore, thereby retaining the tool in the tool holder.

When the machine is subsequently put into use, the tool will rotate within the sleeve, but the wear ring will be retained against rotation by the ends of the cut out portion of the sleeve that engage the sides of the protrusion of the wear ring. The wear ring is therefore locked with the sleeve and cannot rotate without causing rotation of the sleeve.

Another aspect of the invention is that the outer diameter of the wear ring is larger than the outer circumference of the tool holder adjacent the forward surface thereof. A forked extraction tool is provided, having a pair of prongs spaced far enough apart to fit around the forward end of the tool holder and behind the outer ends of the wear ring. The extraction tool may thereafter be pounded with a hammer to remove the tool from the tool holder. Since the extraction tool fits behind the wear ring, the extraction tool will remove both the wear ring and the tool and the wear ring will not fall upon the work surface so as to require subsequent removal.

In one embodiment of the invention, the outer circumference of the wear ring has at least one ear extending from the outer circumference thereof. An extraction tool in accordance with the invention may thereafter be fitted around the tool and behind the ear or ears of the wear ring, to thereby simplify the extraction of the tool.

BRIEF DESCRIPTION OF THE DRAWINGS

A better understanding of the present invention will be had after a reading of the following detailed description taken in conjunction with the drawings wherein.

DETAILED DESCRIPTION OF PREFERRED EMBODIMENT

Figure 1:
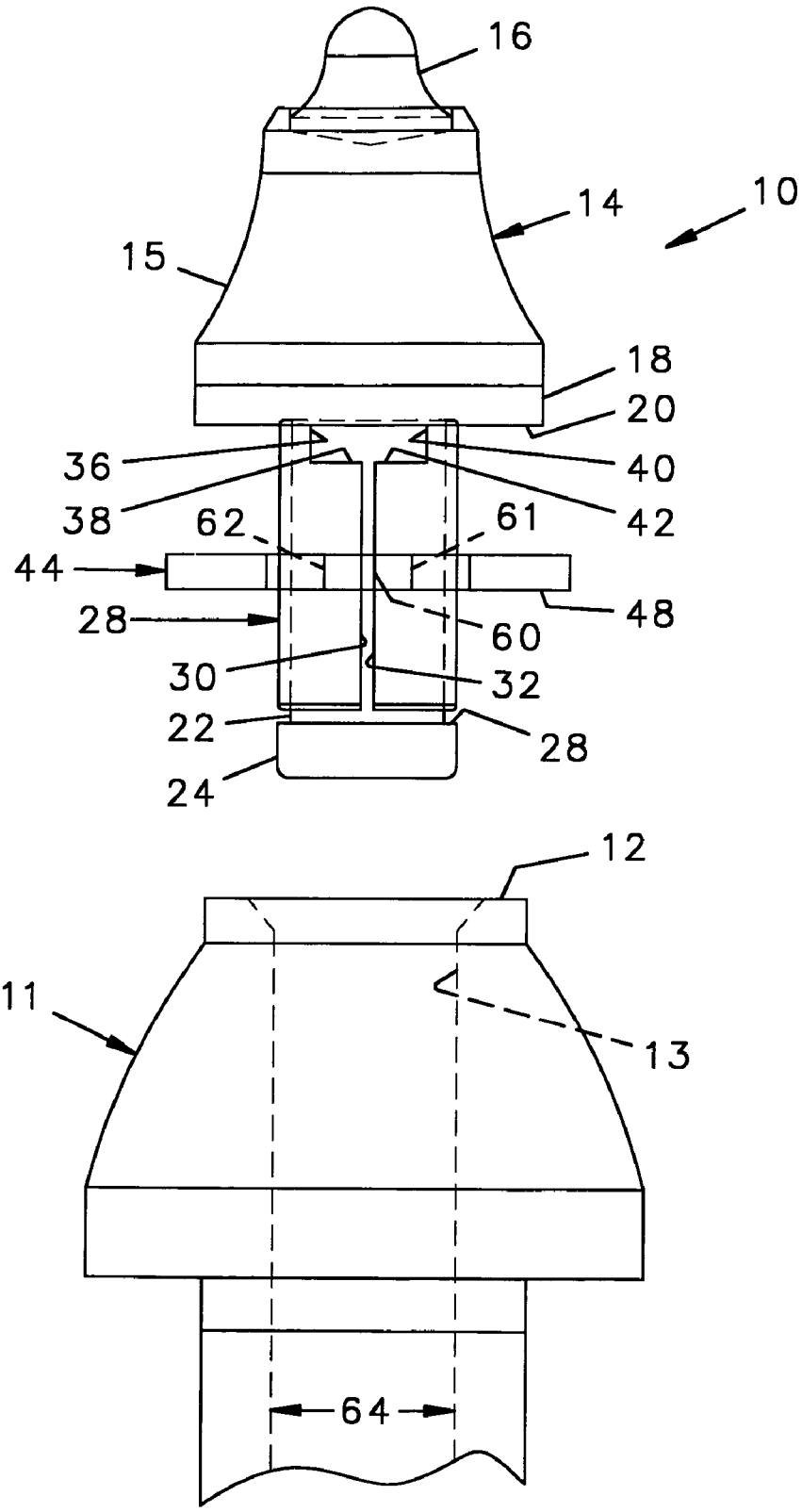
FIG. 1 is a side elevational view of a tool fitted with a sleeve and a wear ring in accordance with the present invention positioned for insertion into a tool holder, with the inner parts thereof shown in broken lines.
Figure 2:
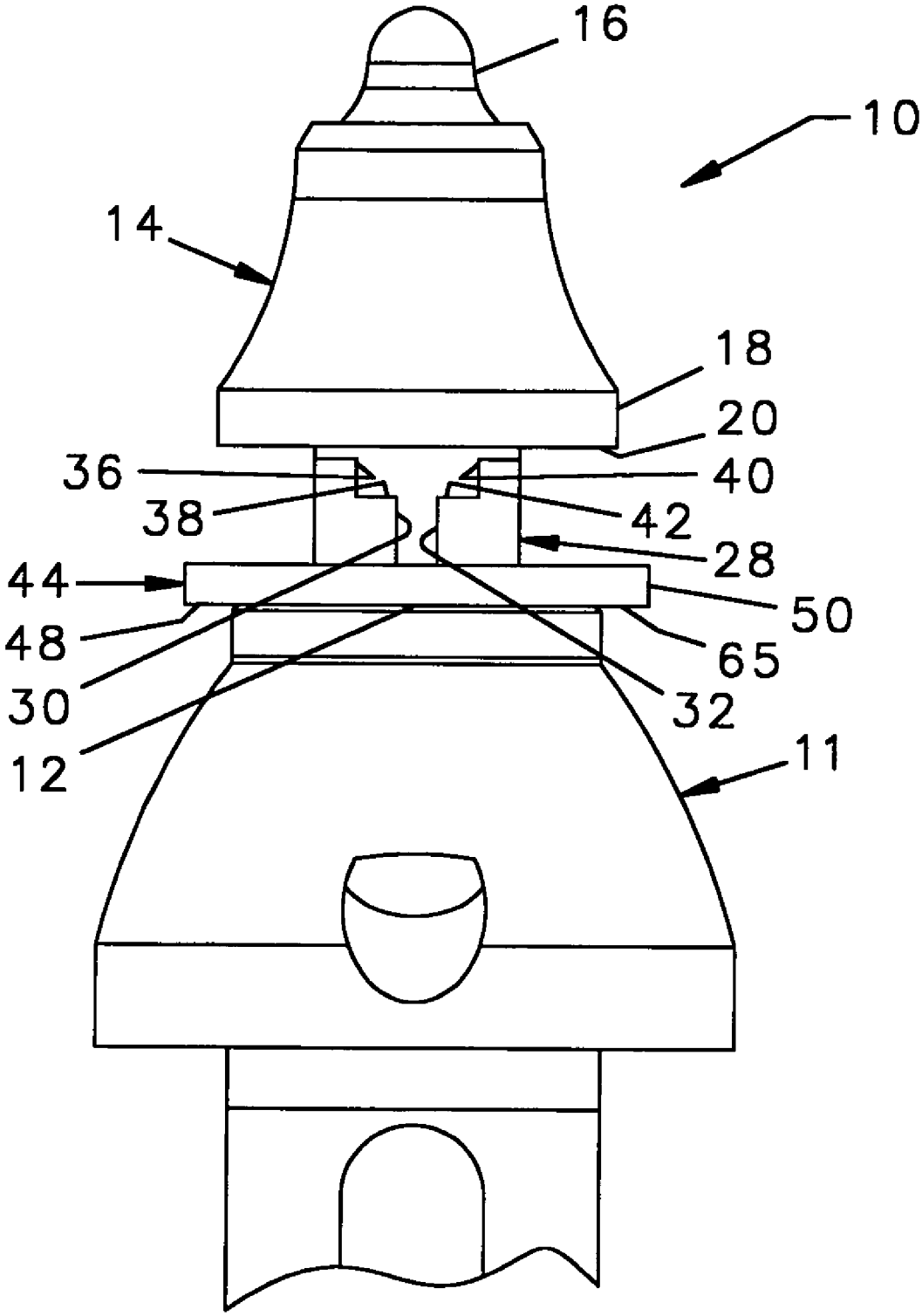
FIG. 2 is a second side-elevational view of the tool and tool holder shown in FIG. 1 with the shank of the tool partially inserted into the bore of the tool holder.
Figure 3:
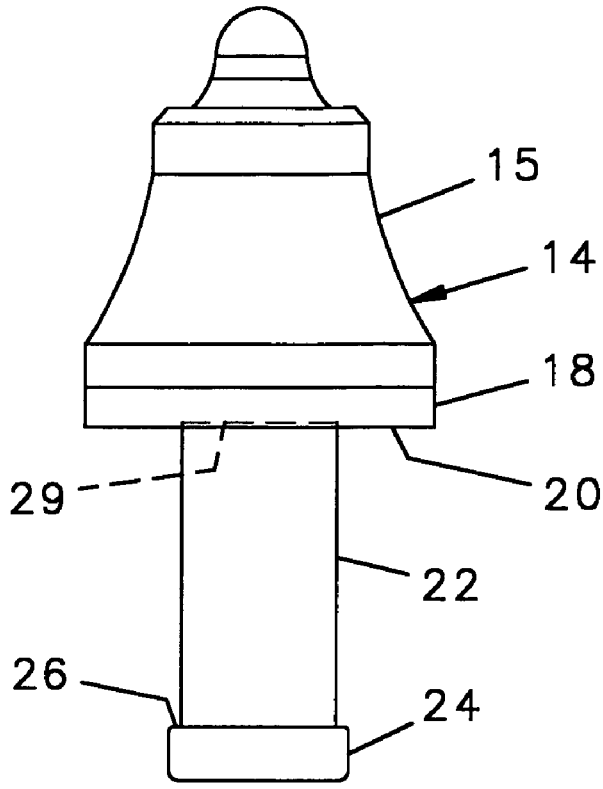
FIG. 3 is a side-elevational view of the tool shown in FIG. 1 without the sleeve and wear ring assembled thereto.

Referring to FIGS. 1 and 3, a tool 10 is suitable for being rotatably mounted in a tool holder 11 having a planar forward surface 12 and a bore 13, the axis of which is perpendicular to the forward surface 12. The tool holder 11 may be mounted directly to the drum or wheel of the machine or may be a quick change holder as depicted. The tool 10 includes a tool body 14 having a tapered forward cutting portion 15 at the forward end of which is a seat into which is brazed a hardened cutting tip 16. The cutting portion 15 flares outwardly near its rearward end to a flange 18 having a generally planar annular rearward surface 20. Extending axially rearwardly from the center of the annular rearward surface 20 is a cylindrical shank 22 having an enlarged hub 24 at the distal end thereof. The hub 24 forms a shoulder 26, and fitted forwardly of the shoulder 26 is a compressible sleeve 28.

As shown in FIG. 3, the cylindrical body of the shank 22 extends without interruption from the rearward surface 20 to the shoulder 26 such that the forward surface of the sleeve 28 abuts against the rearward surface 20. To ensure that the forward end of the sleeve 28 can be positioned co-planar with the plane of the rearward surface, an indent 29 may be provided at the junction of the shank 22 with the rearward surface 20 to remove any filet that may otherwise be formed between these two surfaces.

Since the sleeve 28 extends to the rearward surface 20 of the flange 18 it will never become pinched between a shoulder near the flange and the tool holder 11 as was the case with Simon. The sleeve 28 can therefor be made to fit to closer longitudinal tolerances than a sleeve for a tool such as Simon. The axial clearance between each end of the sleeve and the adjacent shoulder for prior art tools is about 0.060 inches, but the axial clearance for the sleeve 28 of the present invention can be reduced to about 0.020 inches. Reducing the space between the forward end of the sleeve 28 and the flange 18 reduces the amount of fine material cut by the tool that enters between the parts and thereby reduces the wear suffered by the parts.

Referring to FIGS. 5 through 10, the compressible sleeve 28 generally defines a hollow cylinder with an elongate slot extending axially in the length of the wall forming parallel spaced slot edges 30, 32. At the forward end of the sleeve 28 adjacent slot edge 30, is a cut out portion defined by an axial wall 36 and an arcuate wall 38. Similarly, at the forward end of the second slot edge 32 is a second cut out portion defined by an axial wall 40 and an arcuate wall 42.

Figure 4:
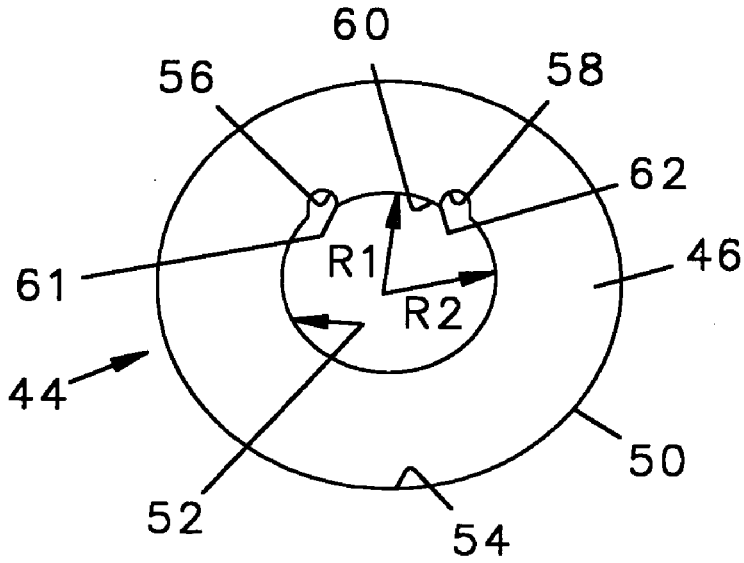
FIG. 4 is a front-elevational view of the wear ring shown in FIG. 1.
Figure 5:
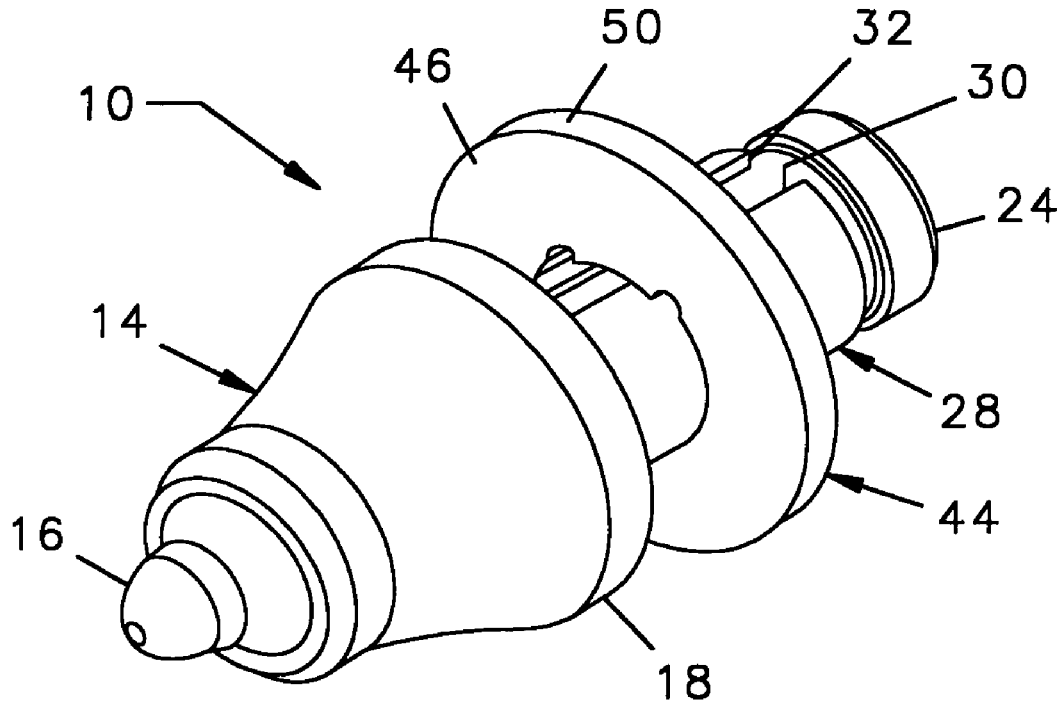
FIG. 5 is an isometric view of the tool, sleeve, and wear ring assembled prior to insertion into a tool holder.
Figure 6:
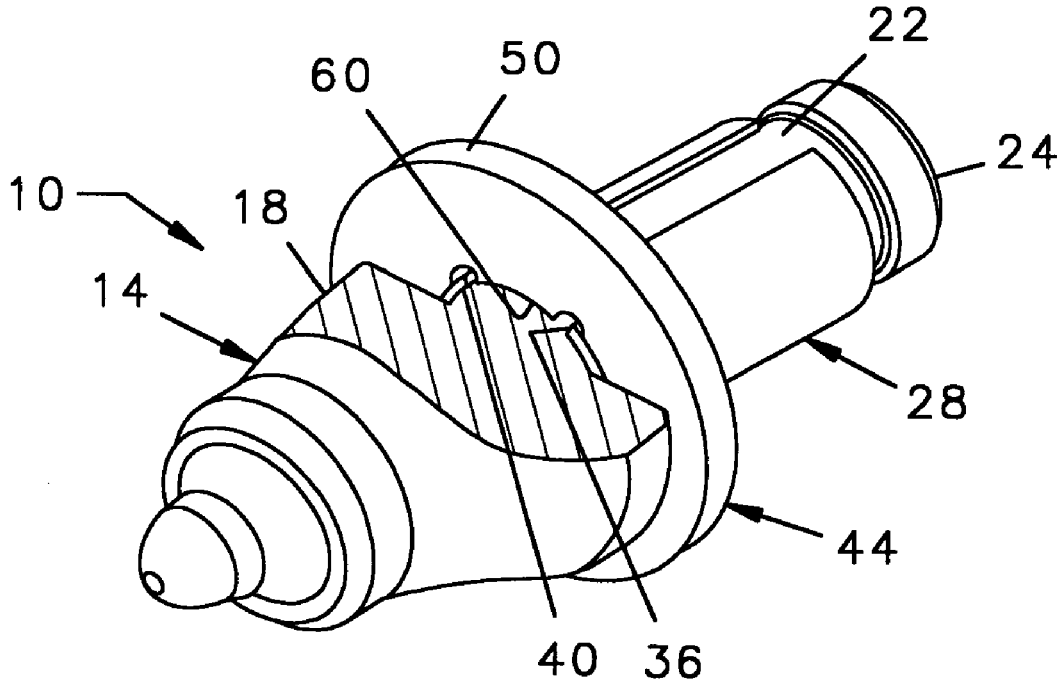
FIG. 6 is an isometric view of the tool, taken partially in cross-section, and the sleeve and wear ring in their respective orientations after the tool has been inserted into the bore of a tool holder.
Figure 7:
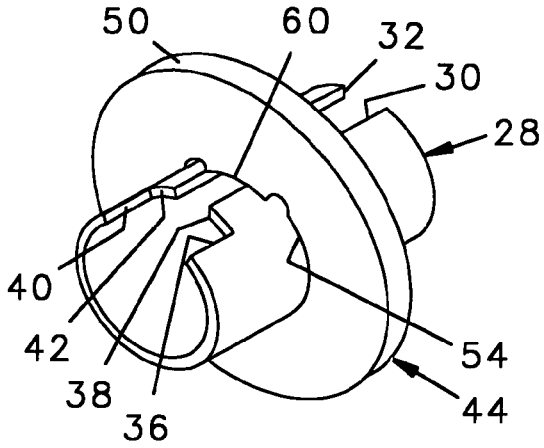
FIG. 7 is an isometric view of the sleeve and wear ring assembled together as shown in FIG. 5, but with the tool removed.
Figure 8:
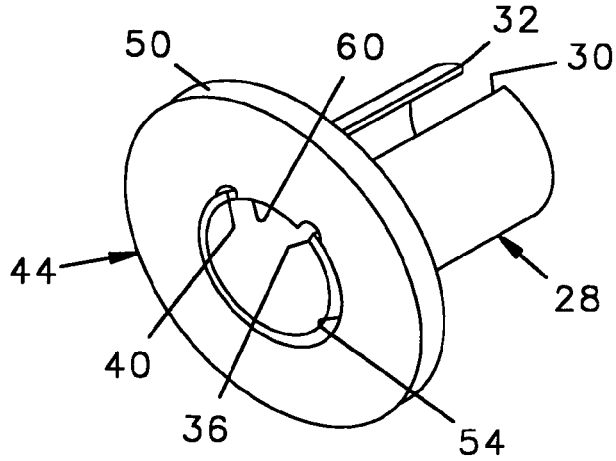
FIG. 8 is an isometric view of the sleeve and wear ring assembled together as shown in FIG. 6, but with the tool removed.

Referring to FIGS. 1 and 4, fitted around the compressible sleeve 28 is a wear ring 44 having a planar forward surface 46, a parallel planar rearward surface 48, a generally cylindrical outer surface 50, and a central opening 52. The inner wall of the central opening 52 has a semi-cylindrical portion 54, a cross-section of which defines approximately 300 degrees of a circle. At the ends of the semi-cylindrical portion 54 are radially outwardly extending notches 56, 58. Between the notches 56, 58 is a radially inwardly extending arcuate portion 60 having sides 61 and 62. The inner surface of the arcuate portion 60 defines a cylinder having a center co-axial with the center of the semi-cylindrical portion 54 but having a radius R1 that is substantially less than the radius R2 of the semi-cylindrical portion 54. The diameter of the opening defined by semi-cylindrical portion 54 is greater than the diameter 64 of the tool holder 11.

As shown in FIGS. 1 through 10, prior to insertion of the shank 22 of the tool 10 into a bore 13 of a tool holder 11, the wear ring 44 is fitted around the central portion of the circumference of the sleeve 28 with the arcuate portion 60 extending across the edges 30, 32 of the slot therein.

Figure 9:
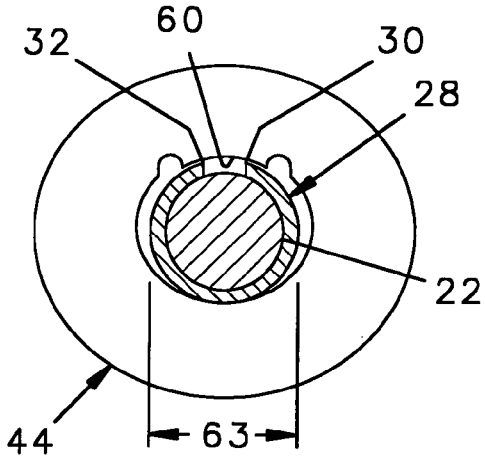
FIG. 9 is a cross-elevational view of the shank of the tool and of the sleeve with the wear ring assembled thereto as shown in FIG. 5.
Figure 10:
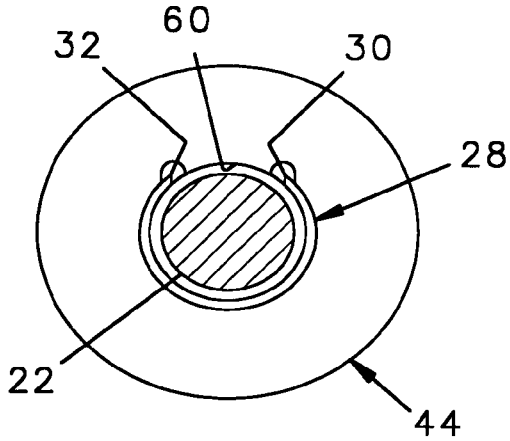
FIG. 10 is a cross-sectional view of the shank of the tool, showing the configuration of the sleeve with the parts assembled thereto as shown in FIG. 6.

Referring specifically to FIGS. 1, 9, and 10, the inwardly directed protrusion of the arcuate portion 60 compresses the sleeve 28 to a diameter 63 that is less than the inner diameter 64 of the bore 13 of the tool holder 11, so that the distal end of the shank 22 of the tool 10, including a portion of the sleeve 28 can be manually inserted by a technician into the bore 13 using only one hand. The machine operator will be able to insert the distal end of the shank 22 until the rearward surface 48 of the wear ring 44 contacts the planar forward surface 12 of the tool holder 11. Thereafter, the cutting tip 16 of the tool 10 is pounded with a hammer to drive the shank 22 with the sleeve 28 thereon into the bore 13 of the holder 11. As the shank 22 is driven into the bore 13 the wear ring 44 is moved forwardly along the sleeve until the arcuate protrusion 60 thereof drops into the cut out portion 36, 38, 40, 42, after which the sleeve 28 can expand to the full diameter of the bore 13 of the tool holder 11.

Referring to FIGS. 1, and 5 through 10, an important aspect of the invention is that the axial walls 36, 40 of the cut out portions at the forward end of the sleeve 28, as it is being compressed by the wear ring 44, are spaced further apart from each other than the width of the arcuate portion 60 of the wear ring 44 as defined by the distance between the sides 61 and 62. Accordingly, when the shank 22 of the tool 10 is driven entirely into the bore 13 of the tool holder 11, the wear ring 44 will be forced to the forward end of the sleeve 28 and the arcuate portion 60 will drop between the axial walls 36, 40 of the compressible sleeve 28. When this occurs, the compressible sleeve 28 will be released from beneath the arcuate portion 60 and allowed to expand. Since the diameter defined by semi-cylindrical portion 52 is larger than the diameter of the inner bore 13 of the tool holder 11, the compressible sleeve will expand until the outer surface thereof contacts the inner surface of the bore 13 of the tool holder 11. The tool 10 will thereafter be retained within the bore 13 of the tool holder 11 by the radially outwardly applied force of the partially compressed sleeve 28. Furthermore, the wear ring 44 will be retained against rotation with respect to the sleeve 28 by the contact of the sides 61, 62 of the arcuate portion 60 against the axial walls 36, 40 of the cut out portions at the forward end of the sleeve 28. Accordingly, the wear ring 44 is prevented from rotating with the tool 10 and will not cause rotational wear to the forward surface 12 of the tool holder 11.

Figure 13:
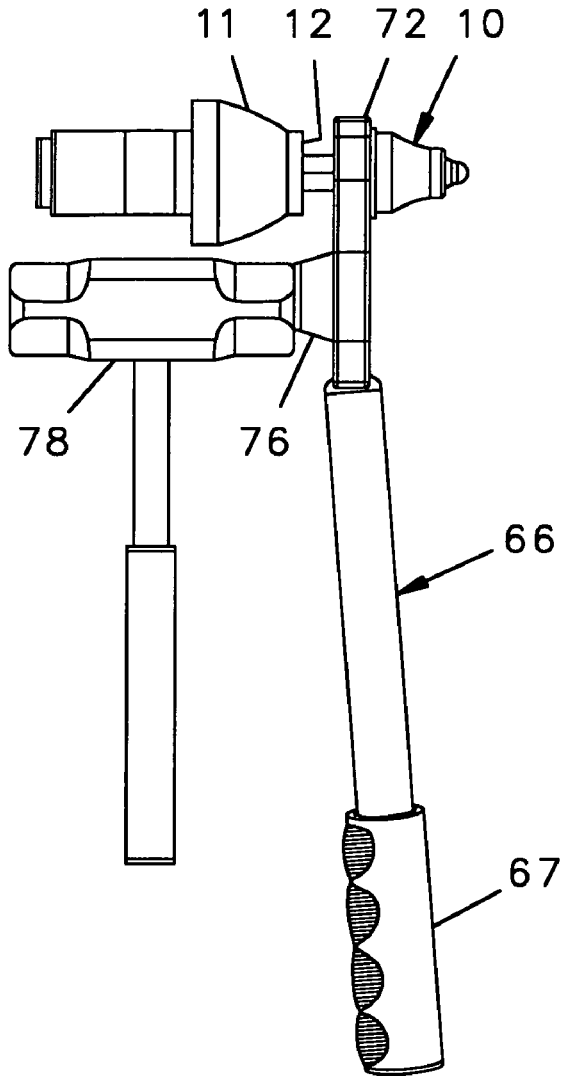
FIG. 13 is a side-elevational view of the tool shown in FIG. 12 being used to remove the tool shown in FIG. 1 from the tool holder.

Referring to FIGS. 2 and 11–14, another aspect of the invention is that the diameter of the cylindrical outer wall 50 of the wear ring 44 is larger than the diameter of the forward end 12 of the tool holder 11, thereby leaving an annular shoulder 65 caused by the overhang of the larger diameter wear ring 44. To remove the tool 10 from the tool holder 11 after the tool 10 has become worn, an elongate tool 66 is provided having a handle 67 at one end thereof and a fork 68 having parallel spaced prongs 70, 72 at the distal end thereof. The spacing 74 between the prongs 70, 72 is larger than the diameter of the forward end of the tool holder 11, but smaller than the diameter of the cylindrical outer wall 50 of the wear ring 44 such that the prongs 70, 72 can be fitted behind the shoulder 65 formed by the wear ring 44 as shown in FIG. 13. The tool 66 further includes an impact portion 76 that can be struck by the head of a hammer 78 while the prongs 70, 72 are positioned under the overhang 65 to thereby remove the tool 10 from the tool holder 11.

It should be appreciated that there is another advantage for providing a wear ring 44 in which the diameter of the outer cylindrical wall 50 is larger than the diameter of the forward end 12 of the tool holder 11. Specifically, the enlarged diameter of the cylindrical outer wall 50 provides further protection to the forward end of the tool holder 11 against washaway caused by the movement of particles of hard material broken free by the forward cutting end 16 of the tool 10 as the tool 10 cuts hard material.

Figure 11:
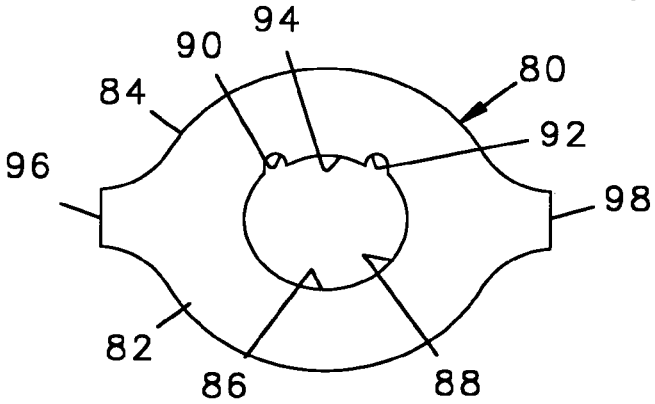
FIG. 11 is a front-elevational view of a second embodiment of a wear ring in accordance with the invention.
Figure 12:
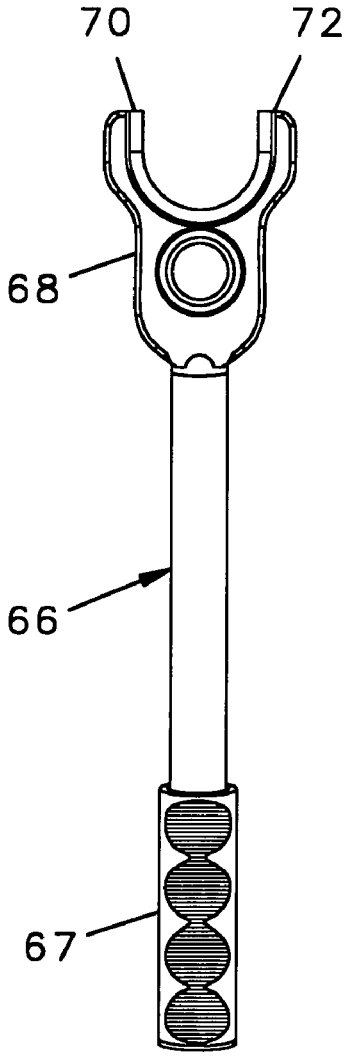
FIG. 12 is a rear-elevational view of an extraction tool for removing the tool shown in FIG. 1 from the tool holder.
Figure 14:
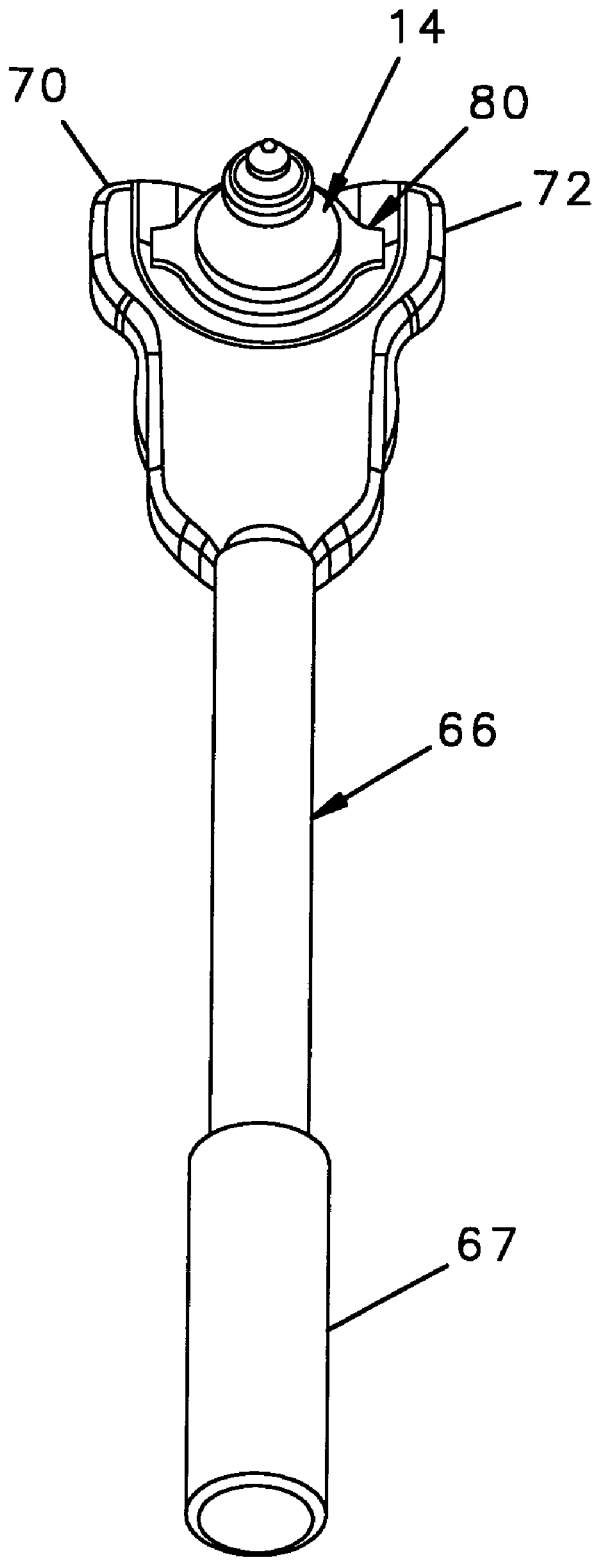
FIG. 14 is an isometric view of the tool holder shown in FIG. 1 fitted around a tool having a wear ring in accordance with FIG. 11, prior to extraction of the tool from the a tool holder.

Referring to FIGS. 11 and 14, a second embodiment of a wear ring 80 has planar forward and rearward surfaces, of which only the forward surface 82 is visible, a generally cylindrical outer surface 84 and a central opening 86. Like the wear ring 44 described above, the central opening 86 of the wear ring 80 has a semi-cylindrical portion 88, the cross-section of which defines approximately 300 degrees of a circle. At the ends of the semi-cylindrical portion 88 are a pair of notches 90, 92 and extending between the notches 90, 92 is an inwardly projecting arcuate portion 94 that generally defines a cylinder having a radius that is less than the radius of the semi-cylindrical portion 88.

The wear ring 80 differs from the wear ring 44 in that it further includes diametrically opposed first and second radially outward projecting ears 96, 98. As can be seen in FIG. 14, the ears 96, 98 can be easily engaged by the prongs 70, 72 of the extraction tool 66 to thereby simplify the removal of the tool 10 from the tool holder 11.

While the invention has been described with respect to a single embodiment, it will be appreciated that many modifications and variations may be made without departing from the true spirit and scope of the invention. It is therefore the intent of the appended claims to cover all such modifications and variations which fall within the spirit and scope of the invention.

The invention claimed is:

1. A rotatable tool assembly for insertion into a tool holder having a cylindrical bore, said tool assembly comprising a tool body having a tapered forward cutting end, an axial shank extending rearwardly of said forward cutting end, and a rearwardly facing annular surface joining a rearward end of said forward cutting end to a forward end of said shank, a generally cylindrical compressible sleeve around said shank, said compressible sleeve having an axis, a forward end adjacent said annular surface, and a longitudinal slot having generally parallel spaced apart slot edges, said compressible sleeve having a cut out portion at said forward end, said cut out portion defined by a longitudinal side wall circumferentially spaced from both said slot edges, said cut out portion having a first width, an annular wear ring having a central opening and a protrusion extending radially inward of said central opening, said protrusion having a second width less than said first width, said wear ring around said compressible sleeve with said protrusion aligned axially rearward of said cut out portion, said compressible sleeve compressed by said protrusion to a first diameter, said wear ring axially moveable along said compressible sleeve to a position around said forward end thereof where said protrusion will extend into said cut out portion and said compressible sleeve will expand to a second diameter larger than said first diameter.

2. The tool assembly of claim 1 wherein said protrusion is positioned across said parallel spaced apart slot edges to compress said sleeve to said first diameter.

3. The tool assembly of claim 2 wherein said cut out portion is at a forward end of one of said slot edges.

4. The tool assembly of claim 1 wherein said cylindrical bore of said tool holder has a diameter that is greater than said first diameter wherein a portion of said compressible sleeve can be manually inserted into said cylindrical bore.

5. The tool assembly of claim 1 wherein said compressible sleeve is compressed to said first diameter between said protrusion and a portion of said central opening diametrically opposite said protrusion.

6. The tool assembly of claim 1 wherein said cylindrical bore of said tool holder has a diameter that is less than said second diameter wherein said compressible sleeve will retain said tool assembly within said cylindrical bore.

7. The tool assembly of claim 1 wherein said central opening is generally circular and said protrusion extends radially inward of a circumference of a circle defined by said central opening.

8. A rotatable tool for insertion into a cylindrical opening of a tool holder comprising a tool body having a tapered cutting end, a hardened tip at a forward end of said cutting end, an axial shank extending rearward of said forward cutting end and a radial flange joining said axial shank to said forward cutting end, a compressible sleeve around said shank, said compressible sleeve having a cut out portion at a forward end thereof and having a longitudinal slot having generally parallel spaced apart slot edges, said cut out portion connected to one of said slot edges, a wear ring around a central portion of said compressible sleeve axially behind said cut out portion, said wear ring having a central opening with a radially inwardly directed protrusion, and said protrusion extending across said spaced apart slot edges and compressing said compressible sleeve.

9. The rotatable tool of claim 8 wherein said compressible sleeve is compressed by said wear ring to a diameter less than a diameter of said cylindrical opening of said tool holder wherein a portion of said compressible sleeve is manually insertable into said cylindrical opening.

10. The rotatable tool of claim 8 wherein said compressible sleeve is compressed between said protrusion and a portion of said central opening diametrically opposite said protrusion.

11. In a tool having a tool body with a tapered forward cutting end, an axial shank extending rearwardly of said forward cutting end, and a rearwardly facing annular surface joining a rearward end of said forward cutting end to a forward end of said shank, a compressible sleeve around said shank, and a wear ring around said shank adjacent said annular surface, the improvement comprising said compressible sleeve having a longitudinal slot defined by a pair of generally parallel spaced apart slot edges and having a cut out portion positioned at a forward end thereof and wherein said cut out portion includes a wall generally perpendicular to said slot edges and wherein the wall connects to one of said edges, said wear ring having an inner annular wall defining a central opening, and a protrusion on said inner annular wall engaging said cut out portion for locking said wear ring to said sleeve wherein said wear ring cannot rotate with respect to said sleeve.

12. The tool of claim 11 wherein said tool is insertable in a cylindrical opening of a tool holder, and said wear ring extends around said forward end and said central opening of said wear ring defines a diameter larger than a diameter of said cylindrical opening of said tool holder wherein said compressible sleeve will retain said tool within said tool holder.

13. A rotatable tool assembly for insertion into a tool holder having a cylindrical bore, said tool assembly comprising a tool body having a tapered forward cutting end, an axial shank extending rearwardly of said forward cutting end, and a rearwardly facing annular surface joining a rearward end of said forward cutting end to a forward end of said shank, a compressible sleeve around said shank, said compressible sleeve having a forward end adjacent said annular surface, and a longitudinal slot having generally parallel spaced apart slot edges, said compressible sleeve having a cut out portion at said forward end defined by a longitudinal side wall circumferentially spaced from said slot edges, an annular wear ring having a central opening and a protrusion extending radially inward of said central opening, and said protrusion having a width less than a width of said cut out portion, said wear ring around a central portion of said compressible sleeve with said protrusion extending across said slot edges, wherein said compressible sleeve is compressed by said protrusion to a first diameter, said wear ring axially moveable along said compressible sleeve to a position around said forward end wherein said protrusion will fall into said cut out portion and said compressible sleeve will expand to a second diameter larger than said first diameter, and a surface on said protrusion will contact a side wall of said cut out portion to lock said wear ring against rotation with respect to said sleeve.

14. The tool of claim 13 wherein said cut out portion is only at said a forward end of said sleeve.

15. The rotatable tool assembly of claim 13 wherein said first diameter is less than a diameter of said cylindrical bore of said tool holder wherein a portion of said compressible sleeve is manually insertable into said cylindrical bore.

16. The tool assembly of claim 13 wherein said compressible sleeve is compressed to said first diameter between said protrusion and a portion of said central opening diametrically opposite said protrusion.

17. The rotatable tool assembly of claim 13 wherein said second diameter is greater than a diameter of said cylindrical bore of said tool holder wherein said compressible sleeve will expand against an inner surface of said cylindrical bore and retain said tool assembly thereon.

18. A rotatable tool assembly for insertion into a tool holder having a cylindrical bore, said tool assembly comprising a tool body having a tapered forward cutting end, an axial shank extending rearwardly of said forward cutting end, and a rearwardly facing annular surface joining a rearward end of said forward cutting end to a forward end of said shank, a generally cylindrical compressible sleeve around said shank, said compressible sleeve having a forward end adjacent said annular surface and a longitudinal slot having generally parallel spaced apart slot edges, said compressible sleeve having a cut out portion at said forward end, said cut out portion defined by a longitudinal side wall circumferentially spaced from both said slot edges, said cut out portion having a first width, an annular wear ring having a central opening and a protrusion extending radially inward of said central opening, said protrusion having a second width less than said first width, said wear ring around said compressible sleeve with said protrusion aligned axially rearward of said cut out portion, and said compressible sleeve compressed by said protrusion to a diameter less than a diameter of said cylindrical bore of said tool holder wherein a rearward portion of said compressible sleeve is manually insertable into said cylindrical bore.

19. The rotatable tool assembly of claim 18 wherein said wear ring is longitudinally moveable along said compressible sleeve to said forward end where said protrusion will engage said cut out portion.

* * * * *

UNITED STATES PATENT AND TRADEMARK OFFICE

CERTIFICATE OF CORRECTION

PATENT NO. : 7,229,136 B2
APPLICATION NO. : 10/952158
DATED : June 12, 2007
INVENTOR(S) : Phillip A. Sollami It is certified that error appears in the above-identified patent and that said Letters Patent is hereby corrected as shown below:

Column 3,
Line 47, after "is" delete "less" and substitute --greater--

Signed and Sealed this

Fourth Day of March, 2008

JON W. DUDAS
*Director of the United States Patent and Trademark Office*